United States Patent [19]

Sowards

[11] Patent Number: 4,933,996

[45] Date of Patent: Jun. 19, 1990

[54] TOILET DEODORIZER

[76] Inventor: Edward W. Sowards, 160 Ridge Rd., Ben Lomond, Calif. 95005

[21] Appl. No.: 356,468

[22] Filed: May 25, 1989

[51] Int. Cl.[5] ..... E03D 9/04

[52] U.S. Cl. ..... 4/213; 4/209 R

[58] Field of Search ..... 4/213–217, 4/209

[56] References Cited

U.S. PATENT DOCUMENTS

| | | | |
|---|---|---|---|
| 1,972,774 | 9/1934 | Hartwell | 4/213 |
| 2,105,794 | 1/1938 | Norris | 4/213 |
| 2,221,940 | 11/1940 | Burrows | 4/213 |
| 2,297,935 | 10/1942 | Baither | 4/213 |
| 2,371,923 | 3/1945 | Sanford et al. | 4/213 |
| 2,575,778 | 11/1951 | Wilson | 4/213 |
| 2,985,890 | 5/1961 | Baither | 4/213 |
| 3,049,722 | 8/1962 | Boggs | 4/213 |
| 3,335,431 | 8/1967 | Coates | 4/213 |
| 4,011,608 | 3/1977 | Pearson | 4/213 |
| 4,044,408 | 8/1977 | Pearson | 4/213 |
| 4,103,370 | 8/1978 | Arnold | 4/213 |
| 4,221,129 | 9/1980 | Baker | 4/213 |
| 4,318,192 | 3/1982 | Williams et al. | 4/213 |
| 4,344,194 | 8/1982 | Pearson | 4/213 |
| 4,365,361 | 12/1982 | Sanstrom | 4/213 |

*Primary Examiner*—Henry K. Artis

*Attorney, Agent, or Firm*—Fleit, Jacobson, Cohn, Price, Holman & Stern

[57] ABSTRACT

A ventilation system is provided including a blower assembly mounted within the air space in the upper portion of a toilet flush tank, which air space is communicated with the upper interior portion of the associated toilet bowl through an overflow pipe disposed in the water tank, and the blower assembly includes an air inlet opening into the air space and an air outlet with which the inlet end of conduit structure is sealingly communicated. The conduit structure includes an outlet end opening into the outlet of the associated toilet bowl below the water seal thereof and the conduit structure includes a normally closed solenoid operated flow control valve serially connected therein, the blower assembly including an electric drive motor. The electric solenoid and drive motor are serially electrically connected for simultaneous operation and an actuating switch is included and operatively associated with the pivotally mounted seat of the toilet bowl for closing the switch only in response to a predetermined downward pressure being applied to the seat. Of course, the switch is serially connected in a circuit electrically connecting the blower drive motor and solenoid to a suitable source of electrical potential.

11 Claims, 2 Drawing Sheets

TOILET DEODORIZER

BACKGROUND OF THE INVENTION

1. Field of the Invention

This invention relates to a ventilation system whereby a toilet bowl, vented to an air space in the upper portion of an associated water tank, may have odorous air pumped therefrom through the air space and discharged into the waste outlet for the toilet bowl downstream from the water seal or check of the toilet bowl, as long as a user of the toilet is seated upon the seat thereof, and in a manner insuring that sewer gases from the toilet bowl outlet will not back up into the air space within the upper portion of the water tank either when the toilet is in use or during periods of non-usage thereof.

2. Description of Related Art

Various different forms of toilet ventilators heretofore have been provided such as those disclosed in U.S. Pat. Nos. 2,221,940, 3,335,431, 4,011,608, 4,044,408, 4,222,129, 4,318,192 and 4,365,361. However, these previously known forms of toilet ventilators do not include the overall combination of structural and operational features of the instant invention.

SUMMARY OF THE INVENTION

The toilet ventilator of the instant invention operates to vent, through the utilization of a blower assembly, the air space in the upper portion of a toilet water tank to the outlet for the toilet bowl downstream from the water check or seal of the toilet bowl, the air space in the upper portion of the water tank being communicated with the air space within the toilet bowl above the water level therein by the usual overflow pipe for the water tank defining the uppermost water level therein. The inlet for the blower assembly is communicated with the air space within the water tank and the outlet of the blower assembly is communicated, by conduit means, with the outlet for the toilet bowl downstream from the water check thereof. The conduit means includes an inline gravity operated flap-type check valve as well as a solenoid operated gas flow valve which is normally closed and the solenoid operated valve and the motor for the blower assembly are electrically connected in an electrical circuit for simultaneous operation, there being provided an operating switch for sensing weight in excess of a predetermined value applying a downward pressure on the seat of the toilet bowl for electrically connecting the aforementioned circuit to a suitable source of electrical potential.

The main object of this invention is to provide a toilet bowl ventilation system for venting odorous air from within the toilet bowl, through the overflow pipe of the associated water tank and thereafter into the outlet for the toilet bowl below the water check or seal thereof.

Another object of this invention, in accordance with the immediately preceding object, is to provide a toilet bowl ventilating system using a motor driven blower assembly for accomplishing the desired ventilation operation and wherein communication between the abovementioned overflow pipe and the toilet bowl outlet is terminated during periods of non-use of the blower assembly.

Another very important object of this invention, in accordance with the preceding objects, is to provide an electrical control for the blower assembly such that the blower assembly is operated only in response to a weight of a predetermined value applying downward pressure on the seat of the toilet bowl.

Yet another object of this invention is to provide a toilet ventilation system in accordance with the preceding objects and which may be readily incorporated into the manufacture of new toilets and toilet water tanks.

Still another object of this invention is to provide a toilet bowl ventilating system which may be designed for use with conventional 110 V household current or a selected DC voltage, such as 6 or 12 volt current, as desired.

A final object of this invention to be specifically enumerated herein is to provide a toilet ventilation system in accordance with the preceding objects and which will conform to conventional forms of manufacture, be of simple construction and fully automatic in operation so as to provide a device that will be economically feasible, long-lasting and relatively trouble free.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
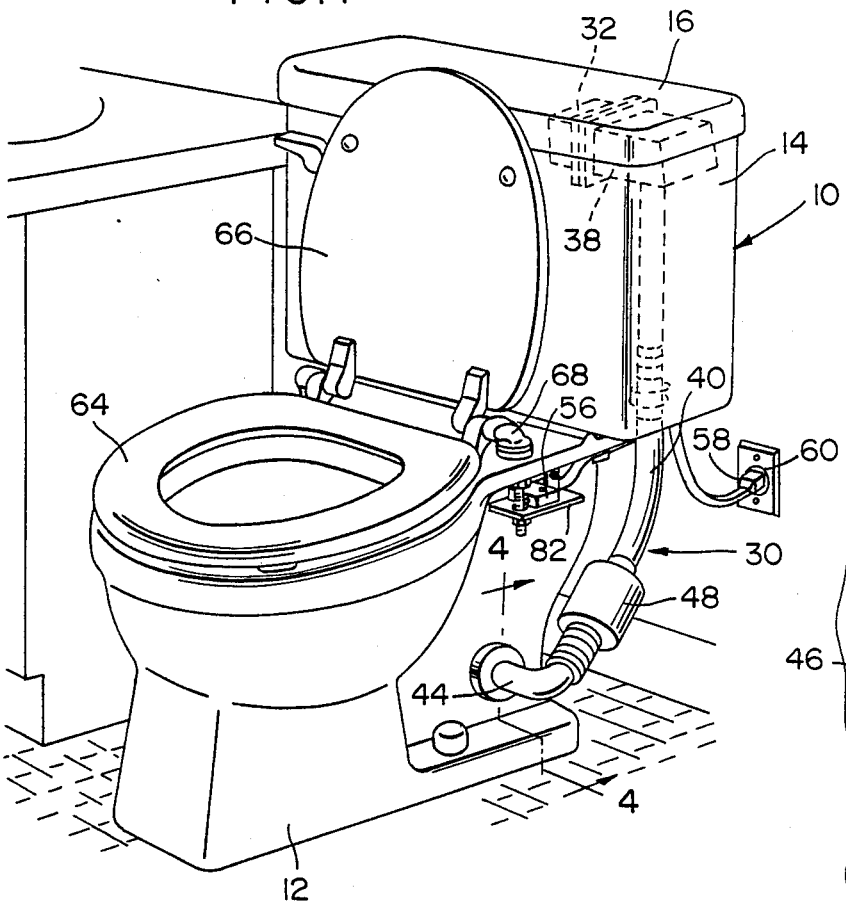
FIG. 1 is a perspective view of a conventional toilet bowl and water tank assembly which has been modified in accordance with the present invention.

Referring now more specifically to the drawings, the numeral 10 generally designates a somewhat conventional toilet assembly including a toilet bowl 12 and a flushing water supply tank 14 including an upwardly removable cover 16.

As is conventional, the assembly 10 includes a flushing mechanism 18 by which water within the tank 14 may be released therefrom into the upper portion of the bowl 12 for flushing the latter, the bowl 12 including a siphon-type outlet 20 therefor and a normal water level 22 defining a water check or seal 24 between the interior of the bowl 12 above the water level 22 and the outlet 20. In addition, the toilet assembly 10 further includes an overflow pipe 26 through which excess water admitted into the tank 14 may be discharged into the bowl 12 and subsequently past the water seal 24 and out the outlet 20, there also being included in the flushing mechanism float controlled means (not shown) for supplying water to the tank 14 and terminating the supply of water to the interior of the tank 14 upon the water reaching the predetermined level 28 thereof below the top of the overflow pipe or tube 26.

Figure 4:
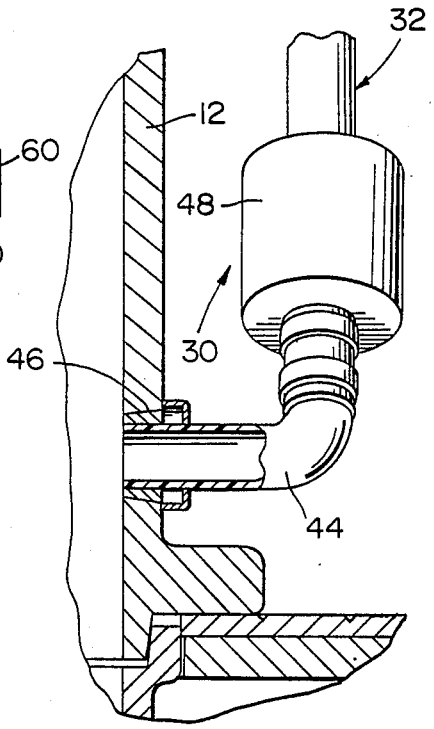
FIG. 4 is an enlarged fragmentary vertical sectional view taken substantially upon the plane indicated by the section line 4—4 of FIG. 1.
Figure 3:
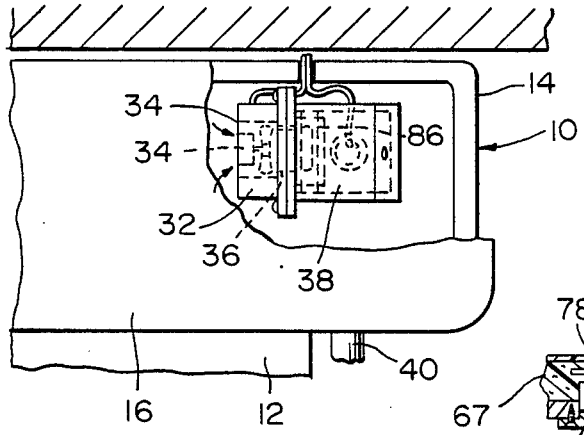
FIG. 3 is a fragmentary top plan view of the water tank portion of the assembly illustrated in FIG. 1 with portions of the cover for the water tank being broken away.
Figure 6:
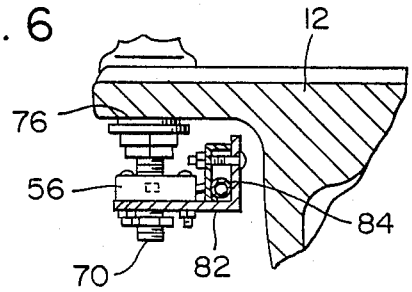
FIG. 6 is a fragmentary vertical sectional view taken substantially upon the plane indicated by the section line 6—6 of FIG. 2.

The ventilation system of the instant invention is referred to in general by the reference numeral 30 and includes a blower assembly referred to in general by the reference numeral 32 and including an electric drive motor 34 mounted within the upper portion of the interior of the tank 14 above the level 28. The blower assembly 32 includes an inlet 34 and an outlet 36. The outlet 36 is connected by a gravity operated, flap-type check valve 38 to conduit structure 40 extending downwardly through the tank 14 and exiting therefrom through the bottom wall 42 of the tank 14 in fluid tight sealed engagement therewith. The conduit structure 42 continues on downwardly below the tank 14 and includes an outlet end 44 opening into the body of the toilet bowl 12 in the area of the outlet 20 and through a port 46 specifically provided therefor formed in the toilet bowl 12, see FIGS. 2 and 4.

The conduit structure 40 is multi-sectional to facilitate service thereon and a flow controlling valve 48 is serially connected in the conduit structure 40 closely adjacent the port 46 to minimize the volume of air within the outlet end 44. The valve 48 includes a valve member 50 normally spring biased to a closed position and openable under operation of an electric solenoid 52 enclosed in the valve 48. Hence, the valve member 50 normally is in the closed position blocking the flow of fluid (gas) through the conduit structure 40, but may be opened, upon actuation of the solenoid 52, to allow substantially unrestricted free flow of fluid through the conduit structure 40 from the upper portion of the interior of the tank 14 to the outlet 20.

Electrical circuit means 54 electrically connects the drive motor 34 and the solenoid 52 for simultaneous operation and the circuit means 54 has a control switch 56 serially connected therein, the circuit means also including an electrical plug 58 for electrically connection with a suitable supply 60 of household current.

Of course, if household current is used to operate the drive motor and solenoid 52, each of these electric components will be capable of operation when supplied with 110 V current. However, the drive motor 34 and solenoid 52 could be constructed for operation with a selected DC voltage such as 6 or 12 volt current and the supply or source 60 of electrical potential would then comprise a source of direct current (not shown).

Also, it is to be noted that while the conduit structure 40 extends downwardly through the water 20 in the tank 14 and also downwardly through the bottom wall 42 of the tank 14, the conduit structure 40 as well as the blower assembly 32 and check valve 38 could be disposed fully exteriorly of the tank 14 in a manner similar to that disclosed in the abovementioned prior U.S. Pat. No. 4,044,408. Also, if the drive motor 34 is to be retained within the upper portion of the interior of the tank 14, the drive motor 34 may be of the explosion-proof type.

Figure 5:
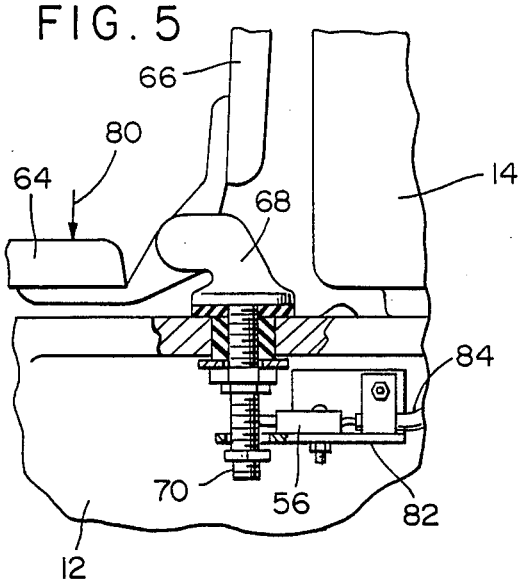
FIG. 5 is a fragmentary side elevational view of the central portion of the assembly illustrated in FIG. 2 and with the weight sensing switch thereof actuated to close the electrical circuit to the blower motor and solenoid valve of the ventilation system.
Figure 2:
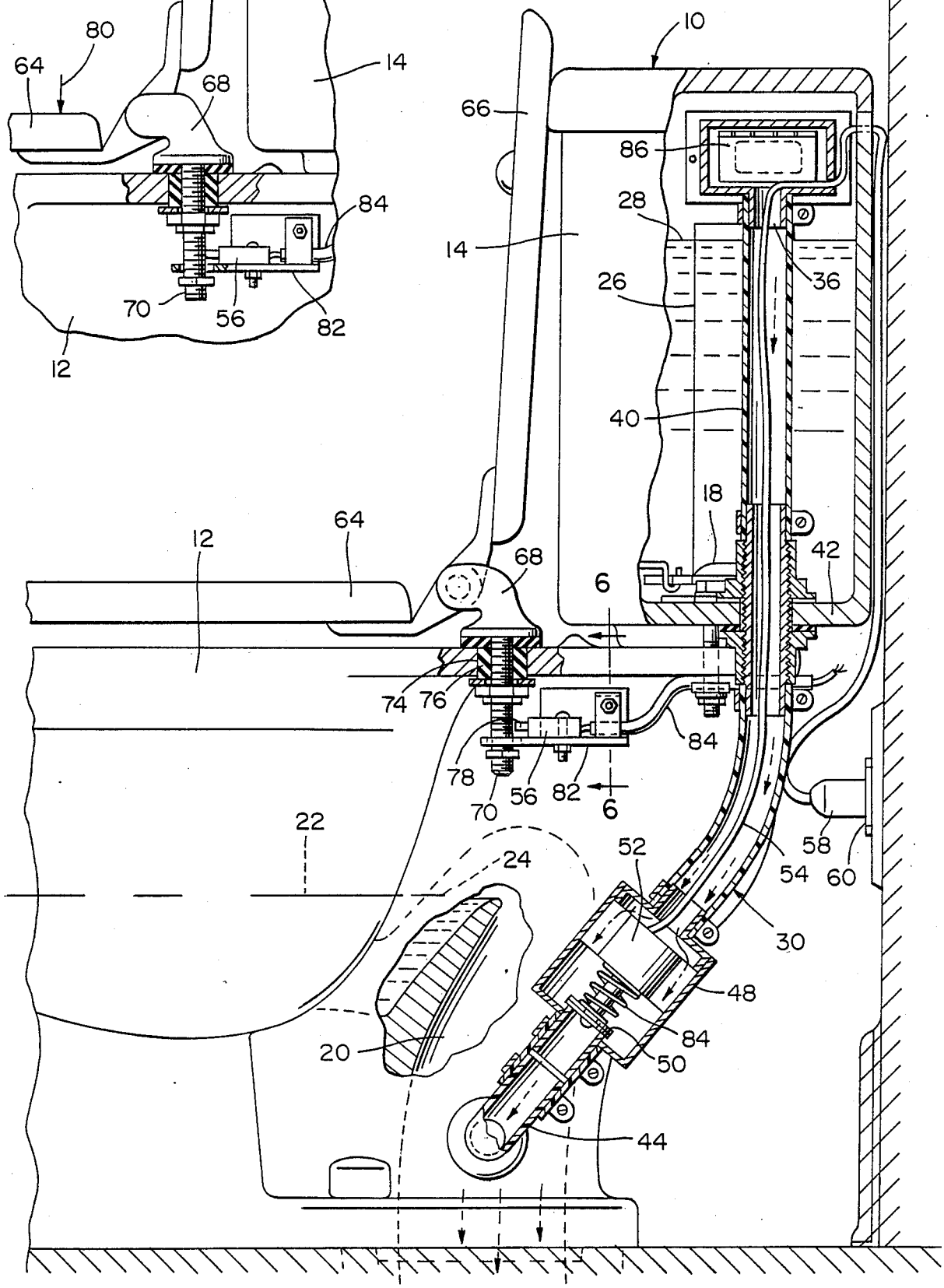
FIG. 2 is an enlarged fragmentary side elevational view of the assembly illustrated in FIG. 1 with portions of the water tank, toilet seat mounting structure, toilet bowl and the ventilation system of the instant invention broken away and illustrated in vertical section.

With attention now invited more specifically to FIGS. 2 and 5 of the drawings, it may be seen that the toilet assembly 10 additionally includes a toilet seat 64 hingedly supported for movement between an operative horizontal position closely overlying the upper rim of the bowl 12 and a raised inoperative position disposed closely forward of the upstanding pivotally mounted cover 66 for the toilet seat. However, the toilet seat 64 is mounted in cantilever fashion from a pair of mounts 68 including mounting shank portions 70 projecting downwardly through bores 74 formed in the toilet bowl 12 and resilient grommets 76 extending through the bores 74 receiving the mounting shank portions 70 therethrough. The switch 56 includes a push—type operator 78 engageable by the associated mounting shank portion 70 when a predetermined load 80 exerts a downward pressure upon the toilet seat 64, see FIG. 5. The switch 56 is supported from a bracket 82 relative to which the corresponding mounting shank portion 70 is shiftable and the bracket 82 is clamp supported from one end of a rigid tube 84 stationarily supported from the toilet bowl 12 and through which the corresponding portions of the circuit 54 extend.

Therefore, assuming the toilet assembly 10 to be in use, the person using the toilet assembly 10 exerts sufficient downward pressure upon the toilet seat 64 by their body weight in order to cause the mounting shank portions 70 operatively associated with the switch 56 to cock slightly in the manner illustrated in FIG. 5 of the drawings and to contact and push or depress the operator 78 in order to close the normally open switch 56. Closing of the switch 56 will complete the circuit from the source 60 to the drive motor 34 and the solenoid 52 whereupon the drive motor will drive the blower assembly and the solenoid 52 will retract the valve member 50 from its closed position toward its open position. Operation of the drive motor 34 will cause the blower assembly 32 to draw odorous atmosphere from within the upper portion of the interior of the tank 14 above the level 28 and to pump that atmosphere downwardly through the conduit structure 40 and into the outlet 20, the evacuation of atmosphere from within the upper portion of the interior of the tank 14 causing a reduction of air pressure within the upper portion of the interior of the tank 14 and ambient air disposed exteriorly of the toilet bowl to flow into the latter and up into the upper portion of the interior of the tank 14 above the level 28 through the overflow pipe 26.

As soon as a person is finishing using the toilet assembly 10 and rises from a seated position on the seat 64, the resilient grommet 76 will return the mounting shank portion 70 operatively associated with the switch 52 to its vertical position illustrated in FIG. 2 and out of engagement with the operator 78 to thus allow the control switch 56 to open. Opening of the control switch 56 will terminate operation of the drive motor 34 and also deactuate the solenoid 52 whereby the valve member 50 will be returned to the closed position thereof illustrated in FIG. 2 of the drawings under the biasing action of the associated spring 84.

Figure 7:
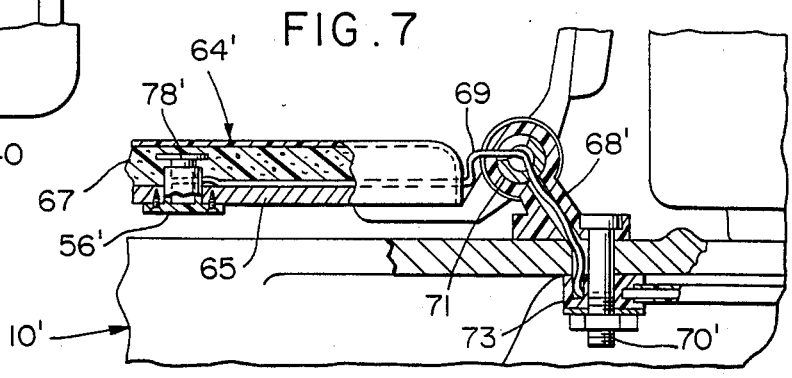
FIG. 7 is a fragmentary side elevational view of a modified form of toilet ventilation system utilizing a different form of pressure operated actuating switch.

With attention now invited more specifically to FIG. 7 of the drawings, a modified form of toilet assembly is referred to in general by the reference numeral 10′ and is substantially identically constructed with the toilet assembly 10, except that the toilet seat 64′ and mount 68′ thereof are slightly modified in construction. The toilet seat 64′ includes a seat frame 65 pivotally supported from the mount 68′ and a resilient cover 67 disposed over the seat frame 65. A switch 56′ corresponding to the switch 56 is mounted from the seat frame 65 and includes an actuator 78′ corresponding to the actuator 78 embedded within the resilient cover 67. In addition, the electrical wiring 69 for the switch 56′ extends through hollow pivot mounting structure 71 for the seat 64′ and through a mounting washer 73 for the mounting shank portions 70′ of the mount 68′. Otherwise, operation of the toilet assembly 10′ is substantially identical to operation of the toilet assembly 10.

In both the disclosed forms of the invention the flap-type check valve 38 and solenoid valve 48 will be used in tandem, or, if the length of the siphon-type outlet 20 is relatively long, the solenoid valve 48 may be omitted.

In a conventional toilet (without the deodorizer of the instant invention) the siphon-type outlet 20 functions, during the latter part of a flushing operation, to siphon water out of the bowl 12 to a level spaced appreciably below the level 22. This results in a more complete flushing action of the bowl 12, particularly in view of the fact that during the latter stages of a flushing operation water is still entering the upper part of the bowl 12 from the tank 14. For these reasons, substantially all waste material is flushed from the bowl 12 before part of the in flow of water to the tank 14 is diverted downwardly through the overflow pipe 26 and into the bowl 12 to raise the level of water therein to the level 22, which water diversion structure is conventional, but not shown.

If the siphon-type outlet is relatively short, the entrance of a substantial quantity of air into the outlet 20 through the port 46 will "break" the siphon action and not allow the above mentioned substantially complete flushing of the waste material from the bowl 12 during the latter stages of a flushing operation. For this reason, the valve 48 is positioned closely adjacent the port 46 and flushing operations should be carried out only after the user of toilet has risen from the seat 64 thereof to terminate operation of the blower 32 and allow the valve 48 to return to its closed position.

If, however, the siphon-type outlet 20 is relatively long and experiences a strong siphoning action, the valve 48 may be omitted, in as much as air entering such a long siphon outlet 20 adjacent the lower end thereof will not "break" the siphoning action of the outlet 20. In such instances, the gravity operated, flap-type check valve 38 may be used alone. The valve 38 is constructed substantially the same as a dryer vent outlet valve is constructed and includes a hinged flap valve member 86 which is slightly inclined from the vertical when in the closed position, the flap valve member 86 being swingable to a greater inclined position relative to the vertical as a result of pressure differential acting thereon during operation of the blower assembly 32.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. In combination with a toilet of the type including a toilet bowl, water tank and water tank cover, said water tank including an overflow conduit whereby water in excess of the desired water level in said tank may be dispensed into said bowl and through which odorous air may be educed from said bowl into said tank above said level, said water tank also including a flushing mechanism whereby water may be discharged into said bowl from said tank to flush said bowl, an air space in said tank below said tank cover and above said desired water level, said toilet bowl including a predetermined water level and a siphon-type outlet below said water level with which said water level coacts to form a water seal between said siphon-type outlet and the interior of said toilet bowl, blower means mounted from said tank including an inlet communicated with said air space and an outlet, conduit means including an outlet opening directly into said siphon-type outlet of said toilet bowl and an inlet end with which said blower outlet is in sealed communication, said conduit means including a normally closed electrically actuable solenoid valve serially connected therein, said blower means including an electric drive motor, said toilet bowl including a seat supported therefrom for swinging movement relative to said toilet bowl between a lowered horizontal position overlying the upper margin of said toilet bowl and a raised upstanding position projecting upwardly from said toilet bowl, and normally open switch means operatively associated with said toilet bowl and seat, circuit means electrically connecting said drive motor, switch means and solenoid valve for simultaneous operation of said drive motor and opening of said solenoid valve responsive to closing of said switch means, said solenoid valve positioned closely adjacent said siphon-type outlet to maintain the internal volume of said conduit means between said solenoid valve and said siphon-type outlet sufficiently small to avoid breaking the siphoning action of said siphon-type outlet when said toilet bowl is flushed and said solenoid valve is closed, said circuit means including means adapted for operative electrical connection with a source of electrical potential.

2. The combination of claim 1 wherein said blower means is mounted within said air space.

3. The combination of claim 2 wherein said blower means outlet opens downwardly and said conduit means includes a substantially vertical upper end portion thereof extending from said blower means outlet and downwardly through a bottom wall portion of said water tank in fluid tight sealed engagement therewith, said conduit means also including a lower outlet end disposed below said bottom wall portion and in which said solenoid valve is serially disposed.

4. The combination of claim 1 wherein said switch means and seat include coacting means operative to close said switch means responsive to downward pressure above a predetermined minimum being applied to said seat.

5. The combination of claim 4 wherein said switch means is mounted from said seat.

6. The combination of claim 5 wherein said seat includes a lower seat frame and a resilient cover applied to and overlying said seat frame, said switch means being supported from said seat frame and including an actuator therefor operable to close said switch responsive to downward pressure above said predetermined minimum being applied to said resilient cover.

7. The combination of claim 4 wherein said switch means is stationarily supported from said toilet bowl, said seat being pivotally supported from mount means therefor in cantilever fashion, said mount means including depending mounting shank portions secured downwardly through mounting bores provided therefor in said toilet bowl and passing through resilient grommets disposed in said bores, said switch means including an actuator therefor engageable by one of said shank portions responsive to said one shank portion being cocked relative to the corresponding bore and grommet responsive to said downward pressure being applied to said mount by a person seated on said toilet seat.

8. The combination of claim 7 wherein said blower means is mounted within said air space.

9. The combination of claim 8 wherein said blower means outlet opens downwardly and said conduit means includes a substantially vertical upper end portion thereof extending from said blower means outlet and downwardly through a bottom wall portion of said water tank in fluid tight sealed engagement therewith, said conduit means also including a lower outlet end disposed below said bottom wall portion and in which said solenoid valve is serially disposed.

10. In combination with toilet of the type including a toilet bowl, water tank and water tank cover, said water tank including an overflow conduit whereby water in excess of the desired water level in said tank may be dispensed into said toilet bowl and through which odorous air may be educed from said toilet bowl into said tank above said level, said water tank also including a flushing mechanism whereby water may be discharged into said toilet bowl from said tank to flush said toilet bowl, an air space in said tank below said tank cover and above said desired water level, said toilet bowl including a predetermined water level and a siphon-type outlet below said water level with which said water level co-acts to form a water seal between said siphon-type outlet and the interior of said toilet bowl, blower means mounted from said tank including an inlet communicated with said air space and an outlet, conduit means including an outlet end opening directly into said siphon-type outlet of said toilet bowl and an inlet end with which said blower outlet is in sealed communication, said conduit including gravity closed check valve means serially connected therein openable in response to pressure in said conduit upstream from said check valve being greater than pressure in said conduit downstream from said check valve, said blower means including an electric drive motor, said toilet bowl including a seat supported therefrom for swinging movement relative to said toilet bowl between a lowered horizontal position overlying the upper margin of said toilet bowl and a raised upstanding position projecting upwardly from said toilet bowl, and normally open switch means operatively associated with said toilet bowl and seat, circuit means electrically connecting said drive motor and switch means for operation of said drive motor responsive to closing of said switch means, said circuit means including means adapted for operative electrical connection with a source of electrical potential, a normally closed electrically actuatable solenoid valve serially connected in said conduit means downstream from said check valve means and closely adjacent said siphon-type outlet to maintain the internal volume of said conduit means between said solenoid valve and said siphon-type outlet sufficiently small to avoid breaking the siphonic action of said siphon-type outlet when said toilet bowl is flushed and said solenoid valve is closed, said circuit means electrically connecting said drive motor, switch means and solenoid valve for simultaneous operation of said drive motor and opening of said solenoid valve responsive to closing of said switch means.

11. The combination of claim 10 wherein said switch means and seat include coacting means operative to close said switch means responsive to downward pressure above a predetermined minimum being applied to said seat.

* * * * *